US006179655B1

(12) United States Patent
Wozniczka et al.

(10) Patent No.: US 6,179,655 B1
(45) Date of Patent: Jan. 30, 2001

(54) ELECTRICAL CONNECTING DEVICE

(75) Inventors: George Wozniczka, Chicago; Robert Holmes, Mt. Prospect, both of IL (US)

(73) Assignee: Philips Electronics North America Corporation, New York, NY (US)

( * ) Notice: Under 35 U.S.C. 154(b), the term of this patent shall be extended for 0 days.

(21) Appl. No.: 09/241,006

(22) Filed: Feb. 1, 1999

Related U.S. Application Data

(62) Division of application No. 08/744,797, filed on Nov. 6, 1996.

(51) Int. Cl.[7] ..... H01R 13/74
(52) U.S. Cl. ..... 439/552; 336/96; 174/DIG. 2
(58) Field of Search ..... 439/552, 562; 336/107, 96; 174/DIG. 2, 52.2

(56) References Cited

U.S. PATENT DOCUMENTS 3,706,066 * 12/1972 Shroyer ..... 439/552
3,728,663 * 4/1973 Kitt ..... 439/552
4,729,740 * 3/1988 Crowe et al. ..... 439/76
4,916,363 * 4/1990 Burton et al. ..... 315/276
5,023,520 * 6/1991 Costa ..... 315/276
5,148,086 * 9/1992 Costa ..... 315/276
5,260,678 * 11/1993 Van Wagener et al. ..... 336/96
5,350,292 * 9/1994 Sanders et al. ..... 439/733
5,350,316 * 9/1994 Van Wagener et al. ..... 439/460
5,364,288 * 11/1994 Drewanz et al. ..... 439/552
5,405,271 * 4/1995 Bauer et al. ..... 439/480
5,433,626 * 7/1995 Drewanz et al. ..... 439/404

* cited by examiner

*Primary Examiner*—Gary F. Paumen
(74) *Attorney, Agent, or Firm*—Ernestine C. Bartlett

(57) ABSTRACT

An electrical connecting device is provided which includes a housing comprising at least one orifice having disposed therein a connector for making electrical connection between electrical power-providing components and electrical power-receiving components. The connector includes inner and outer flange structures which substantially envelop edge portions of the orifice to provide a substantially continuous seal between at least side and bottom edge portions of the orifice and connector. In especially preferred embodiments, the edge portions of the orifice are contained in a groove formed between the inner and outer flange structures.

13 Claims, 10 Drawing Sheets

ELECTRICAL CONNECTING DEVICE

CROSS REFERENCE TO RELATED APPLICATIONS

This is a divisional of application Ser. No. 08/744,797, filed Nov. 6, 1996.

FIELD OF THE INVENTION

This invention relates to electrical connecting devices, more particularly to ballasts for electrical lighting and the like, and connectors therefor, and especially to so-called "connectorized" and "leadless" ballasts which directly carry connectors for attachment to wiring in electrical fixtures such as fluorescent lamp fixtures.

BACKGROUND OF THE INVENTION

Electrical connecting devices are commonly used throughout the lighting industry for connecting electrical leads (wires) together. For example, in connecting a lighting fixture (luminaire) to a ballast, lead wires (hard wired to the ballast) are routed directly to the lamp holders located at opposite ends of the fixture. The lamp holders are typically from two to eight feet apart depending on the length of the lamp for which the fixture is designed. For example, some electrical connectors are designed primarily for fluorescent lighting and are typically located within the fluorescent light fixture. Usually, the electrical ballast comprises a long rectangular metal housing or "can" with the electrical components mounted inside. A sealant or "potting compound" is then deposited inside the can which hardens to seal the electrical components within the can. Usually also, electrical wires present in the can project through the potting material into an electrical connector for interconnection thereto by a mating to electrical connector wires of the fixture.

Such an electrical connector is known from U.S. Pat. No. 4,729,740 to Crowe in which the connector is said to be profiled for receipt within a cutout portion to seal the cavity within the housing during the curing of the potting compound. Some advantages and disadvantages of such a structure as represented by the Crowe disclosure are addressed in U.S. Pat. Nos. 5,260,678 and 5,350,316 (a continuation of U.S. Pat. No. 5,260,678), both to Van Wagener et al. According to the Van Wagener et al patents, the "picture frame" mounting of the Crowe patent results in a construction that is unacceptable requiring extra cost and assembly time to force the connector into place or to wipe away potting compound that leaks from the housing. The Van Wagener et al patents also address a structure in which the connector fits through a window in the sheet metal of the housing and is held in place in the housing by two "ears" which protrude through the side walls of the ballast. Although it is asserted that a good seal can be made between the connector and housing if desired and that leakage is deterred, in actuality such a structure is not leakage-proof. It has been found that such a structure as described in Van Wagener et al also requires extra cost and assembly time because leakage of the potting compound can and does occur due to loose fitting contact between the connector and the housing and indirect mounting of the connector to the window or cut-out in the can. Additionally, as will be discussed further hereinbelow, with reference to FIG. 10 of the Van Wagener et al patents, it will be seen that an external half-connector 70 is mated with an internal half-connector 50. A male pin 96*e* is inserted in a female contact 110*e*. This simple connection in practice is accompanied by misalignment problems. The pin 96*e* does not always fit properly in the contact 110*e* and full insertion is not always achieved. Such misalignment problems are a source of hidden extra costs at assembly time and also cause damage to contacts and other latent defects. Also, with reference again to FIG. 10 of the Van Wagener et al patents, there is disclosed a lower part of a metal wall 21 which forms a lip 21" which extends above the bottom of a hook-receiving chamber 57 formed in the half-connector and which receives a plastic hook 72 to secure the half-connector in place. This construction, before sealing, is prone to leakage and must be sealed prior to insertion in the can. In this case, sealing of the aperture to form the chamber 57 is accomplished by a sealing step or operation such as by ultrasonic welding, gluing or the like. Even after the sealing step, the structure is still prone to leakage and/or suffers from tolerance problems that result from the latching of a plastic part to a metal part.

There continues to be a need in the industry for a connecting device which includes means to exert better control over leakage of the potting compound, which avoids the problems of the prior art by providing latching of plastic part to plastic part without tolerance problems, which provides a latch chamber without the necessity of performing an additional sealing step, which is consistently substantially free of misalignment problems upon insertion of one half-connector into another half-connector, and which is suitable for purposes of ballast retrofit and ballast manufacture in terms of cost and ease of assembly.

SUMMARY OF THE INVENTION

An object of this invention is to provide improved electrical connecting devices such as electrical ballasts which may be easily adapted for connecting wires together, whether for purposes of ballast retrofit or manufacture. Another object of the invention is to provide improved electrical connecting devices that are of such construction that the control of leakage of the potting compound from the housing is substantially improved over that of known electrical connecting devices and which are otherwise free of the problems of the prior art discussed above.

For ease of discussion and illustration, the invention will be described in terms of its application as an electrical ballast. However, it will be understood that the connecting device need not and should not be limited to use as a ballast connector and is suitable for connecting wires of different types of devices together.

The nomenclature used to refer to the ballast herein is as follows: a generally flat coverplate is considered to be the top of the ballast, and the receptacle portion with a bottom wall, and/or a sidewall, and at least one end wall is considered to be the bottom. It will be understood that the ballasts may be inverted and the parts referred to accordingly.

In general, in accordance with the invention, there is provided, in its broadest sense, an electrical connecting device which includes a housing comprising at least one orifice having disposed therein a connector for making electrical connection between electrical power providing components and electrical power receiving components, said connector comprising inner and outer flange means which substantially envelop or sandwich edges of the orifice to provide a substantially continuous seal between at least side and bottom edge portions of said orifice and said connector.

In preferred embodiments of the invention, the electrical connecting device will include an internal half-connector having a plurality of electrical contacts fixed therein and adapted to mate with an external half-connector. In such a device, preferably said internal half-connector comprises inner and outer flange means, preferably inner and outer substantially continuous peripheral flanges which envelop or sandwich edge portions of the orifice, preferably outer and inner side and bottom edge portions of the orifice, to provide a substantially continuous seal between at least side and bottom edge portions of said orifice and said internal half-connector.

In preferred embodiments, the device also preferably includes at least one tongue defining an edge portion of the orifice, preferably a top edge portion of the orifice, mated with a complementary groove (or ramps thereof) formed in a wall portion of the half-connector, preferably a front top wall portion of the half-connector, such combination being referred to hereinafter as A "tongue and groove" seal.

Another embodiment of the invention includes, in combination, a ballast and connecting apparatus for use in a lamp fixture, preferably a fluorescent-lamp fixture. Such ballasts include at least one electrical winding, and plural electrical leads operatively connected to the winding, for carrying electrical power to and from the winding. The apparatus also includes a housing or can that has two generally upstanding sidewalls, generally enclosing the winding and leads. The housing preferably has two end walls, at least one of which has a cutout portion or orifice.

The connecting apparatus also includes an internal electrical half-connector or receptacle intended to provide power with means for attachment to the electrical conductors of the ballast, and an external half-connector or plug intended to send and/or receive power when coupled with a mating device and establishing connection between the conductors of the various assemblies. The receptacle and plug assembly preferably comprise a single row of 9 pins and/or wire and mating socket terminals that are equally spaced from one another although it will be understood that the particular number of conductive paths is not critical and may be varied as desired. The plug or male housing is a molded polymeric material that houses the current carrying socket contacts and may have an integral locking mechanism while the receptacle housing is a molded polymeric material that contains the contact terminals such as pins and/or wires that mate with the current carrying socket contacts.

The internal electrical half-connector is disposed in at least one cut out portion or orifice of at least one end wall in the manner described hereinabove that substantially improves the control of leakage of the potting compound from the housing when compared to known electrical connecting devices. Generally, the improvement comprises providing in an electrical ballast an electrical connector, preferably an electrical half-connector disposed in at least one orifice of at least one end wall of the ballast, the half-connector and end wall portion of the ballast can or housing having complementary parts whereby upon assembly of the connector into the orifice, there is provided a substantially continuous seal between at least side and bottom edge portions of said cutout portion and said electrical connector disposed therein or attached thereto. As described earlier hereinabove, flange means are provided on the connector, preferably inner and outer peripheral flanges, which envelop or sandwich outer and inner edges or edge portions of the housing, preferably outer and inner side and bottom edges of the orifice. In especially preferred embodiments of the invention, the ballast will comprise:

a substantially continuous seal between at least side and bottom edge portions of said cutout portion and said electrical connector disposed therein, said connector comprising flange means, preferably substantially continuous inner and outer peripheral flanges, which envelop or sandwich outer and inner edges of the housing, preferably outer and inner side and bottom edges or edge portions of the orifice; and at least one tongue defining an edge of said orifice, preferably a top edge of the orifice, mated with a complementary groove formed in a wall of the electrical connector, preferably a front top wall of an electrical half-connector.

In preferred embodiments of the invention, the flange means include collapsible projections at predetermined locations along the peripheral groove of the receptacle half-connector. Such projections are used to accurately position the receptacle within the cut-out portion during assembly, and are effective to help prevent float of the receptacle after it is inserted.

Also in preferred embodiments of the invention, the housing is stiffened as a result of the tongue, a bent stiffening flange, which mates with a groove comprising ramps in the plastic electrical half-connector. Such a construction in addition to stiffening the housing at this point, also acts to lock the half-connector in place in the cutout portion of the housing.

In yet another preferred embodiment of the invention, a novel half-connector for use in completing at least one electrical circuit is provided which comprises an opening in the internal electrical half-connector for mating with the plug or external half-connector. Preferably and especially preferred, an opening and molded-in latch surface (36C) as best seen in FIG. 13 and described further hereinbelow) is provided in the internal electrical half-connector for mating with a plug or external half-connector hook and, further a molded-in sealed, trapped surface is provided, which together with the hook and the molded-in latch surface forms a continuous seal without the need to perform a sealing step as has been necessary heretofore. The novel half-connector is produced by a method which comprises the step of molding a half-connector part using a retractable lifter, internal slider mold mechanism such that the hook engages a plastic latch surface and a molded-in surface forms a sealed latching opening without the necessity to perform sealing by ultrasonic or other sealing means. Such a method and mold mechanism forms the subject of a separate application.

As will be explained further hereinbelow, the electrical connector is complementary in shape to said orifice or cutout portion and, for ease of description, and as illustrated, may be described as a double rectangular "Y". A peripheral groove separates comprises an inner end portion in the shape of a rectangular "Y" and , superimposed thereon, an outer end portion in the shape of a rectangular "Y". A peripheral groove separates the inner and outer end portions of said double rectangular "Y" and receives the edges of the housing orifice that define the cutout portion. As a result, the half-connector engages the various edges of the orifice both inside and outside the can, provides flange means on its inner and outer ends, and provides tongue and groove means, thereby providing improved sealing and retention properties. It will be understood that the orifice or cut-out portion and correspondingly the electrical connector may be of various and differing shapes in addition to that illustrated and described for ease of discussion above and still provide the advantages of the invention, the critical consideration being the provision of inner and outer peripheral flange means that envelop at least substantially all side and bottom edges of the cutout portion. The connector is profiled to receive the inner and outer edges of the orifice and to abut the same both inside and outside the ballast housing. Additionally, various flange means and tongue and groove combinations may be utilized at various locations on the respective housing and connector parts, it being envisioned that the substantially continuous seal may be interrupted by one or several tongue and groove combinations on any side or portion of the housing and connector structures. It will be understood that the collapsible projections formed in the peripheral groove, when present, do not interfere with the seal obtained by the flange means since such projections are substantially flattened or collapsed during assembly.

It will also be understood that the invention contemplates structures wherein the connector is a single connector or an internal half-connector and external half-connector or combinations thereof or structures where internal and external half-connectors are employed where the internal half-connector is the receptacle and where the external half-connector is the plug as described and illustrated herein, as well as structures where the relationship is reversed.

The improved sealing and retention properties of the invention are particularly advantageous when the winding, leads and internal portions of the electrical connector are potted within the housing by pouring liquid potting material that solidifies around them when the prevention and control of leakage is particularly desired. Also during such a stage, the various components including the connector may tend to float or to be dislocated because of the weight of the various components. The tongue and groove feature and the collapsible projections of the invention are particularly useful in retaining the connector in the desired position. The housing tongue functions as a stiffener and both the tongue and collapsed projections act to detent the half-connector into proper position in the cut-out portion.

Plastic materials are most suitable for use in molding a connector for use in the invention as is well known in the art using techniques that are well known in the art.

In accordance with the invention, especially when there is a plurality of electrical wires extending through the fixture but substantially all outside the ballast housing, the second or external half-connector is preferably also provided. The plug or external half-connector holds the outside electrical wires and sockets, and makes electrical connection between wires and corresponding pin contacts in the internal half-connector, respectively.

Preferably, an improved plug which includes plural individual electrical socket terminals formed from or operatively connected or crimped to ends of the electrical leads respectively, is provided. In such embodiments, the contacts are fixed within the plug half-connector, for making electrical connections outside the housing. In especially preferred embodiments, the plug comprises a funnel-shaped or flared end portion which assists in the proper insertion of the plug into the receptacle, consistently assures a substantially perfect insertion and alignment of the various male pins and female contacts, and also serves to protect the terminal.

The external half-connector preferably also includes hook means, with a ratchet action, for locking the external half-connector in engagement with the internal half-connector. It also preferably includes operable release means for releasing the hook means to disengage the half-connectors. The external half-connector also includes at least one wire and socket receiving passageway and preferably contains a plurality of pin receiving passageways. Each wire receiving passageway may include a plurality of protrusions for receiving and retaining wire or most preferably, the plug includes prong portions for assuring a tight fit and retaining the wire in the plug housing. In addition, the external connector slides smoothly into and out of engagement with the internal half-connector, preferably as a result of the funnel-shaped or flared end portion referred to above.

The invention also includes the combination of a ballast and connecting apparatus for use in a fluorescent lamp fixture that has lamp sockets, for connection to such sockets selectively either by discrete wires attached to the ballasts individually or by a group of electrical wires held in an external electrical half-connector, if available, i.e. an electrical half-connector that is external to the ballast, as is well known in the art.

Such a combination includes at least one electrical winding, plural electrical leads operatively connected to the winding, an internal half-connector adapted to mate with such external half-connector, if available; and plural individual electrical contacts operatively connected to the electrical leads, respectively, and fixed within the half-connector for making electrical connections between the leads and the electrical wires. Each contact may be an element of resilient conductive material formed into a generally circumferential conductive socket which receives , generally encircles, and makes a good wiping contact with a bared end of an electrical wire or pin, respectively, all as is well known in the art. The sockets as a group may be arrayed to receive bared electrical wires held in an external connector of a certain configuration.

With regard to field-retrofit use, the improved ballast in all of its forms according to the invention is readily interchangeable with earlier ballasts and is particularly suitable for OEM and retrofit purposes.

DETAILED DESCRIPTION OF PREFERRED EMBODIMENTS

Figure 1:
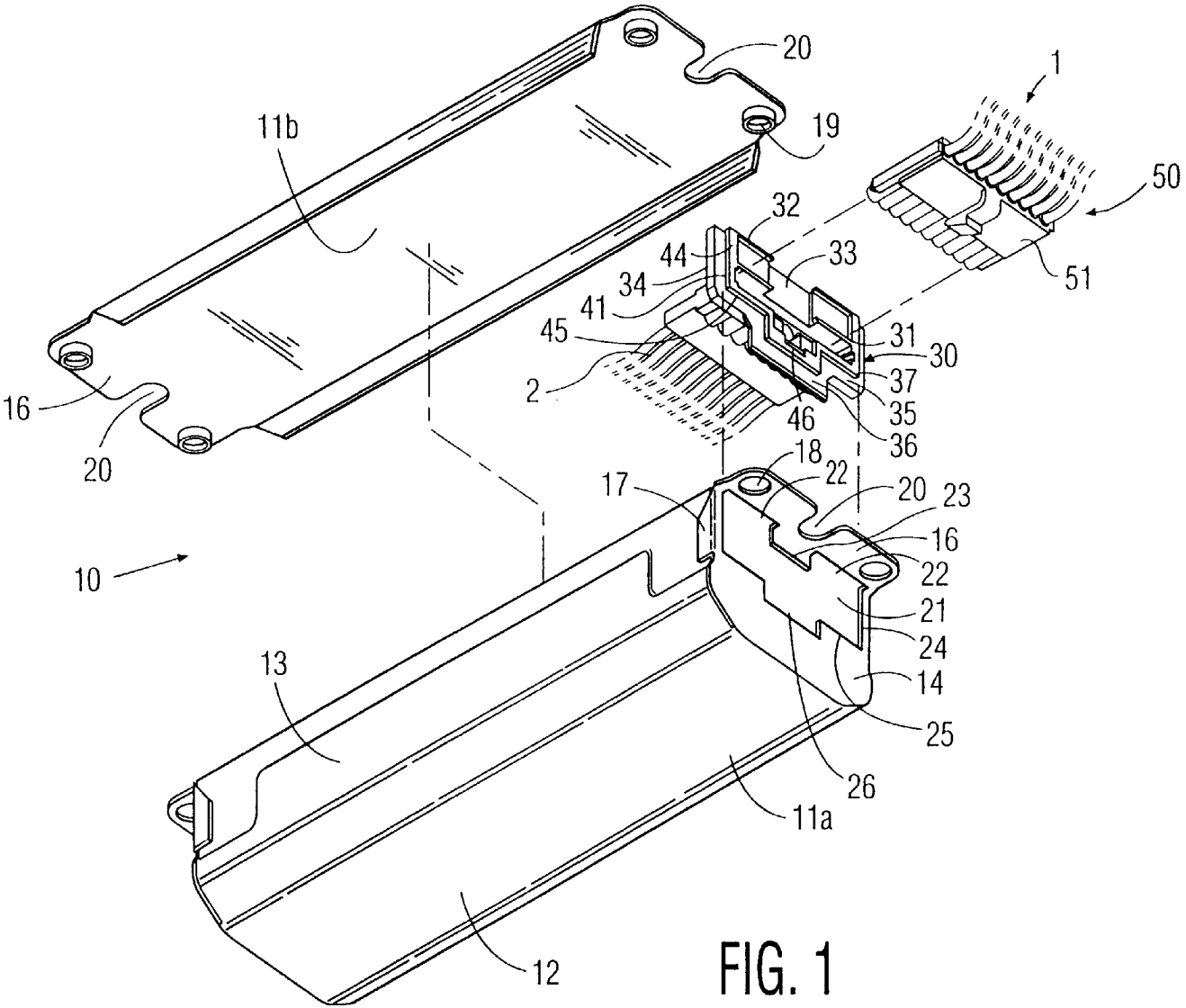
FIG. 1 is a perspective view of the ballast of the invention with certain components exploded therefrom.
Figure 2:
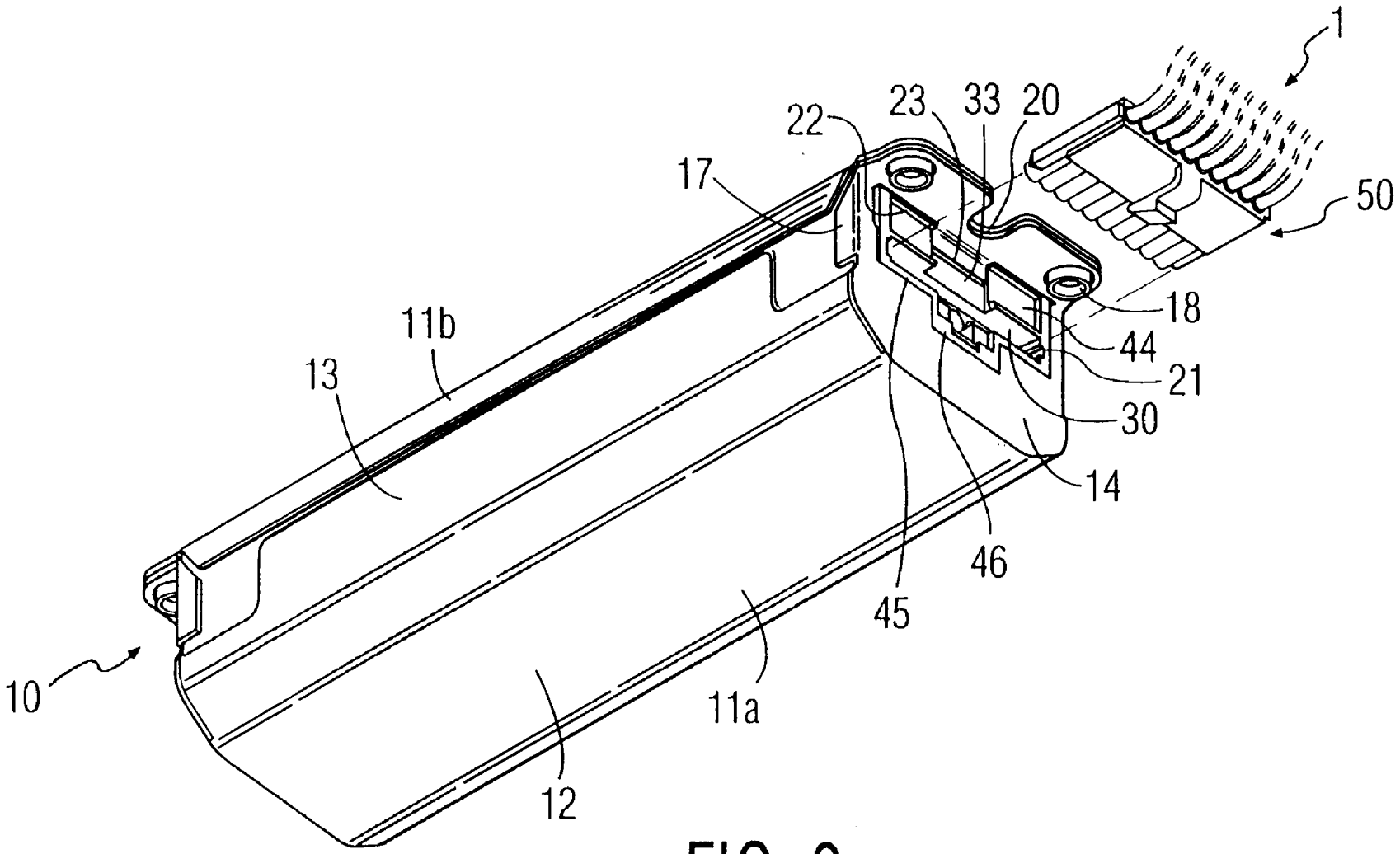
FIG. 2 is a partly schematic perspective view taken from below, showing a ballast with internal half connector in place and an external half connector of the invention.
Figure 3:
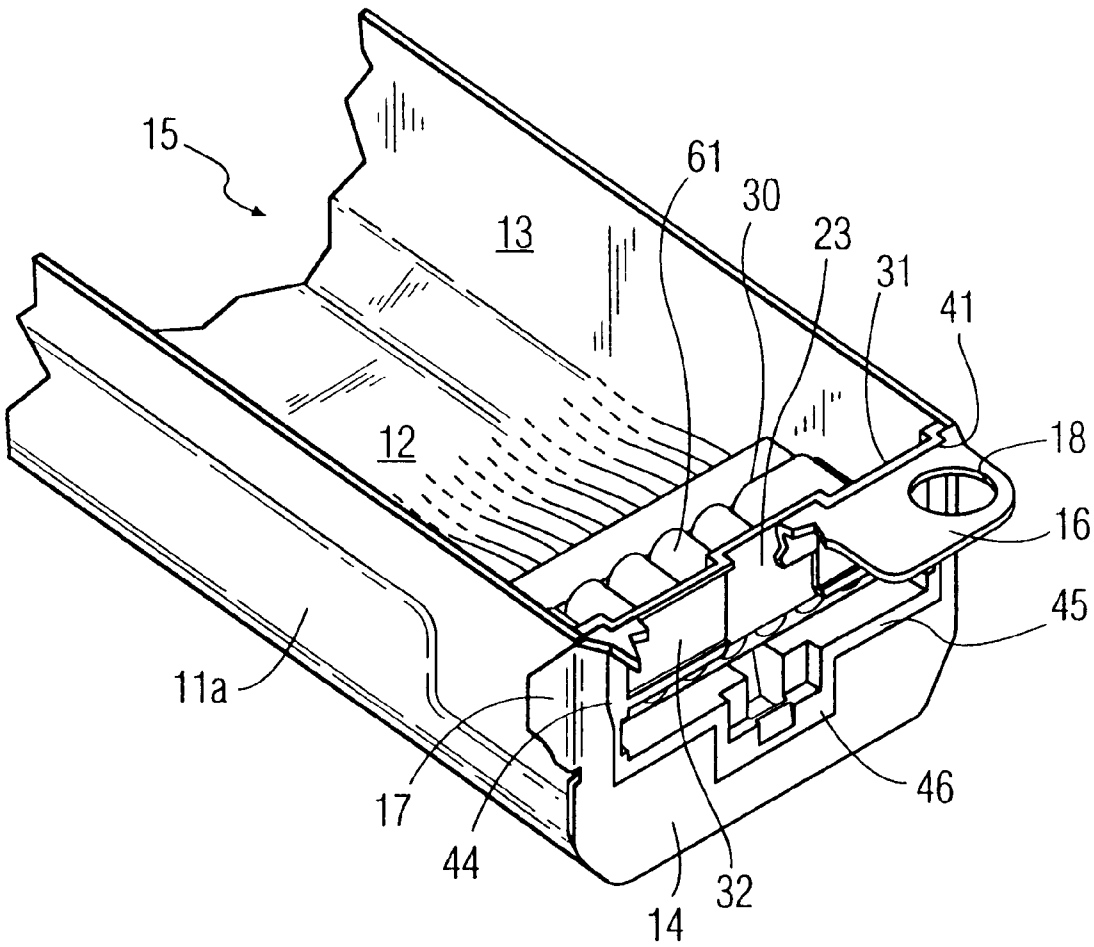
FIG. 3 is a perspective view of one end of a ballast can showing the internal half connector positioned according to the invention.

Lamp sockets, lead wires, external wiring from the lamp sockets to the ballast, and cross-connections or common wiring extensions between parallel or series-wired lamp sockets, and/or systems with a single connector or with two connectors, one at each end of the ballast, ballasts of the electronic type, the external wiring of which may use all or only some of the wiring positions in one or more connectors may be considered as part of the context or environment of this invention, or to the extent recited in the appended claims may be elements of the inventive combination.

With reference to the drawings, and particularly FIGS. 1 through 5B, there is illustrated an electrical connecting device of this invention which includes a ballast 10 which comprises a ballast can 11 having a bottom portion 11*a* and a top cover portion 11*b,* each of which is preferably made from metal. The various components of the ballast are contained within the bottom portion 11*a* and are normally enclosed in a potting compound (not shown). The bottom portion 11*a* has a bottom wall 12, sidewalls 13 and at least one end wall 14. An interior cavity 15 is formed by the bottom wall, sidewall(s) and end wall(s). In the illustrated embodiment, each end wall 14, has end segments 16 and a pair of short side tabs 17, respectively. After assembly, the end segments 16 are generally horizontal and extend longitudinally. It will be understood that the invention encompasses embodiments having no side tab 17 and no horizontal end segment 16.

The end segments 16 are preferably formed with holes 18 for use in connection with the coverplate 11*b* at matching holes 19. Top cover 11*b* also has end segments 16 which contain the holes 19. The end segments 16 of both the top portion 11*a* and the bottom portion 11*b* are preferably slotted at 20 for attachment by suitable fasteners to a luminaire (not shown).

Cut into at least one end wall 14 that will carry an internal half connector 30 is an orifice 21. The orifice or cut-out portion 21 includes inner and outer edges that define its boundaries. For ease of discussion these will be described by the same numeral, it being understood that for example upper edge 22 includes an inner edge and an outer edge. The orifice 21 thus comprises upper edge 22 having a tongue 23 depending therefrom, side edges 24, and intermediate edges 25 on either side of a bottom edge 26. As illustrated, the various edges 22, 24, 25, and 26 and tongue 23 form the shape of a rectangular "Y" shape. As will be explained further hereinbelow, the internal half-connector is complementary in shape to said cutout portion and, as illustrated, may be described as having a double rectangular "Y" shape, i.e. the half-connector 30 comprises an inner end portion 31 in the shape of a rectangular "Y" as defined by edges 34, 35 and 36 and, superimposed thereon, an outer end portion 41 in the shape of a rectangular "Y" as defined as edged 44, 45, and 46. A peripheral groove 37 separates the inner and outer end portions 31 and 41 of said half-connector and receives the inner and outer edges of the cutout portion. As a result, edges 34, 35, 36, 44, 45, and 46 define flange means of the half-connector 30 which engages the inner and outer edges of the cutout portion to provide improved sealing and retention properties. Preferably, in preferred embodiments of the invention, the flange means include collapsible projections 37A (FIG. 13) at predetermined locations along the peripheral groove of the receptacle half-connector 30. Such projections are used to accurately position the receptacle within the cut-out portion during assembly, and are effective to help prevent float of the receptacle after it is inserted.

It will be understood that the cut-out portion 21 and correspondingly the internal half-connector 30 may be of various and differing shapes in addition to that illustrated and described for ease of discussion above and still provide the advantages of the invention, the critical consideration being the provision of inner and outer peripheral flange means that envelop the edges of the cutout portion to provide an effective seal.

Figure 12:
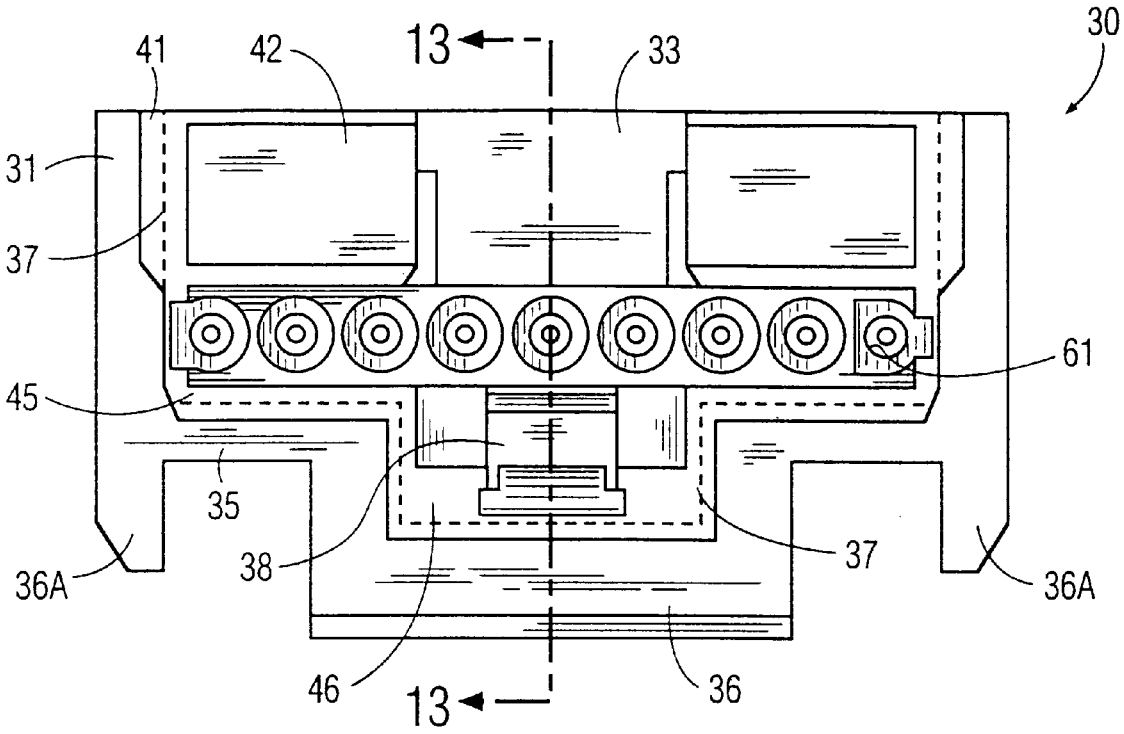
FIG. 12 is a front end view of an alternative embodiment of an internal half-connector of the invention.

The electrical connector of the invention preferably includes a first internal half-connector 30 and a second external half-connector 50. The internal half connector 30 has an inner end 31 which includes an upper wall 32, preferably having a groove 33 and, in most preferred embodiments ramps 33A (FIG. 8) formed therein, side walls 34, and intermediate walls 35 on either side of a bottom flange 36, which in preferred embodiments may be in the form of extended tabs 36A (FIG. 12). An inward peripheral groove 37, with or without collapsible projections 37A extends around the front end of the half connector at its side, intermediate and bottom walls separating outer end 41 which includes raised side walls 44, raised intermediate wall 45 on either side of raised bottom flange 46. The half connector is designed to be mounted with portions of its walls surrounding the edges of the end wall 14 wherein the side, intermediate and bottom edges of the metal can end wall 14 at the orifice is enveloped (1) by the side walls 34, intermediate walls 35 and bottom walls 36 of the half connector on the inside of the can; (2) by the raised side edge 44, raised intermediate edge 45, and raised bottom wall 46 of the half-connector on the outside of the can, and wherein the tongue 23 of the metal end wall is held in the groove 33 of the half connector. The housing is stiffened as a result of the tongue, which functions as a bent stiffening flange, which mates with a groove 33 comprising ramps 33A in the plastic electrical half-connector. Such a construction in addition to stiffening the housing at this point, also acts to lock the half-connector 30 in place in the cutout portion 21 of the housing. The collapsible projections 37A formed in the peripheral groove 37, when present, do not interfere with the seal obtained by the flange means since such projections are substantially flattened or collapsed during assembly. When both are present, the tongue 23 and collapsed projections 37A operate to most effectively detent the half-connector 30 into proper position in the cut-out portion 21 of the ballast can.

It is thus accomplished that substantially all of the metal edges of the orifice 21 are sealed and leakage is substantially eliminated. The metal edges of the ballast can are effectively sandwiched between two layers of plastic in a peripheral groove and are securely fastened in that position via positioning of the ballast tongue 23 in the complementary groove 33 of the half-connector.

Figure 7A:
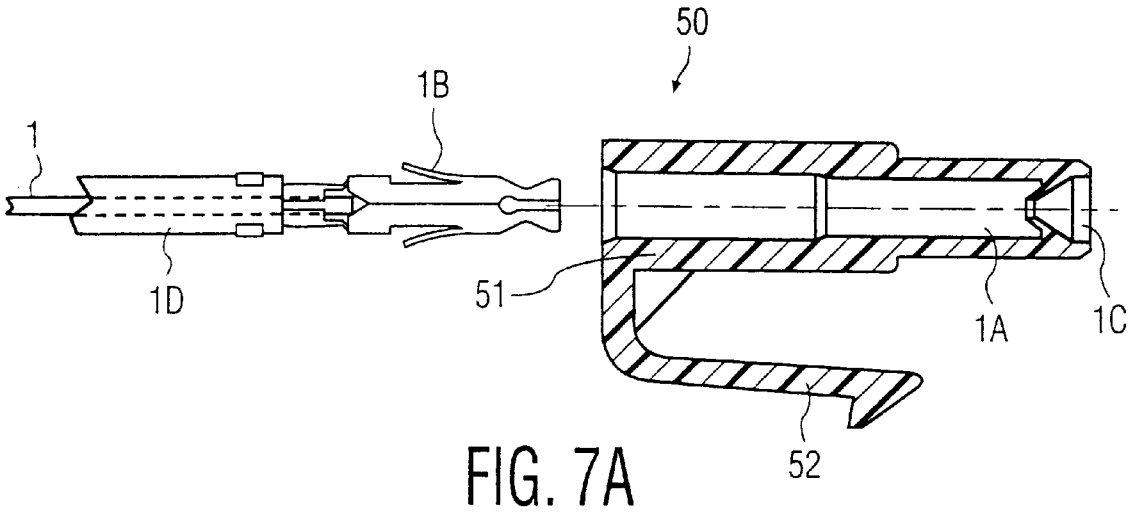
FIG. 7A is an enlarged detail view of a plug or external connector according to the invention and FIG. 7B is a cross-sectional view taken along line 6—6 of FIG. 5, similar to FIG. 6, showing the internal and external half-connectors mated, in a preferred embodiment of the invention.

The external half connector 50 includes a body or plug housing 51, into which all the external wires 1 with socket terminals 1A are connected. The number of wires may vary as desired, for example there may be a total of nine or a lesser or greater number as desired. In the preferred embodiments, the wires are kinked or crimped to prevent the insulation ID from sliding over the conductor thereby preventing exposed conductors and enabling easier positioning of the wire in the receptacle. The plug or male housing 51 is a molded polymeric material that houses the current carrying socket contacts 1A while the receptacle housing 38 is a molded polymeric material that contains the contact terminals 2A such as pins and/or wires 2 with insulation 2D that mate with the current carrying socket contacts 1A. According to the invention, with reference to FIGS. 7A and 7B, the socket terminal 1A is crimped and provides a funnel-like feature 1C on the wire and plug housing that is effective to guide the plug contacts and assure proper alignment upon insertion.

The improved apparatus further may comprise an improved plug which includes plural individual electrical socket terminals formed from or operatively connected or crimped to ends of the electrical leads respectively. In such embodiments, the contacts are fixed within the plug half-connector, for making electrical connections outside the housing. Also in the preferred embodiments, internal half-connector 30 is a receptacle while the external half connector 50 is a plug. Thus, when the plug 50 is mated with the receptacle 30, the forward tip 52 of the external half connector 50 is inserted into an outward-facing cavity 38 formed in the internal half-connector body 39. In other arrangements, the opposite relationship may be used.

In either event, a hook 52 that projects from the external half connector 50 then is inserted into the cavity 38 formed in the internal half-connector body 39. According to a preferred embodiment of the invention, a novel half-connector part 30 for use in completing at least one electrical circuit is provided which comprises an opening 38 in the internal electrical half-connector for mating with the plug or external half-connector 50. Preferably and especially preferred, with reference to FIGS. 7B and 13, the opening 38 includes a molded-in latch surface 36C for mating with the plug or external half-connector hook 52 and, further is defined by a molded-in trapped surface 36B, which, once the hook is inserted into the cavity 38 cooperates to form a continuous seal. As pointed out hereinabove, and as clearly seen in FIG. 7B, this seal is obtained by the interfit of molded plastic parts and not by latching plastic to metal and without the need to perform a sealing step as has been necessary heretofore.

It will be seen that the molded -in parts make it possible to obtain plastic to plastic mating and yields superior alignment of the respective parts. This may be contrasted with the structure illustrated in FIG. 10 of the Wagener et al patents wherein plastic hook 73 is mated with metal part 23 of 21" which is more difficult to achieve and is accompanied by misalignment and tolerance problems.

The ballast may be assembled in known manner. The internal half connector is preferably slidingly installed to sandwich the metal edges of the ballast can by sliding the metal edges 22, 24, 25 and 26 into the peripheral groove 37 while pressing or otherwise urging the tongue 23 into the groove 33. Ramps 33A slide past the tongue 23 with stiffening flange for retention. Preferably, this assembly is accomplished before the ballast can is finally assembled although it can be readily accomplished after final assembly of the can as well. Internal leads 2 and their associated electrical components 3 through 6 (FIG. 4) may be installed and secured by means well known in the art.

Figure 4:
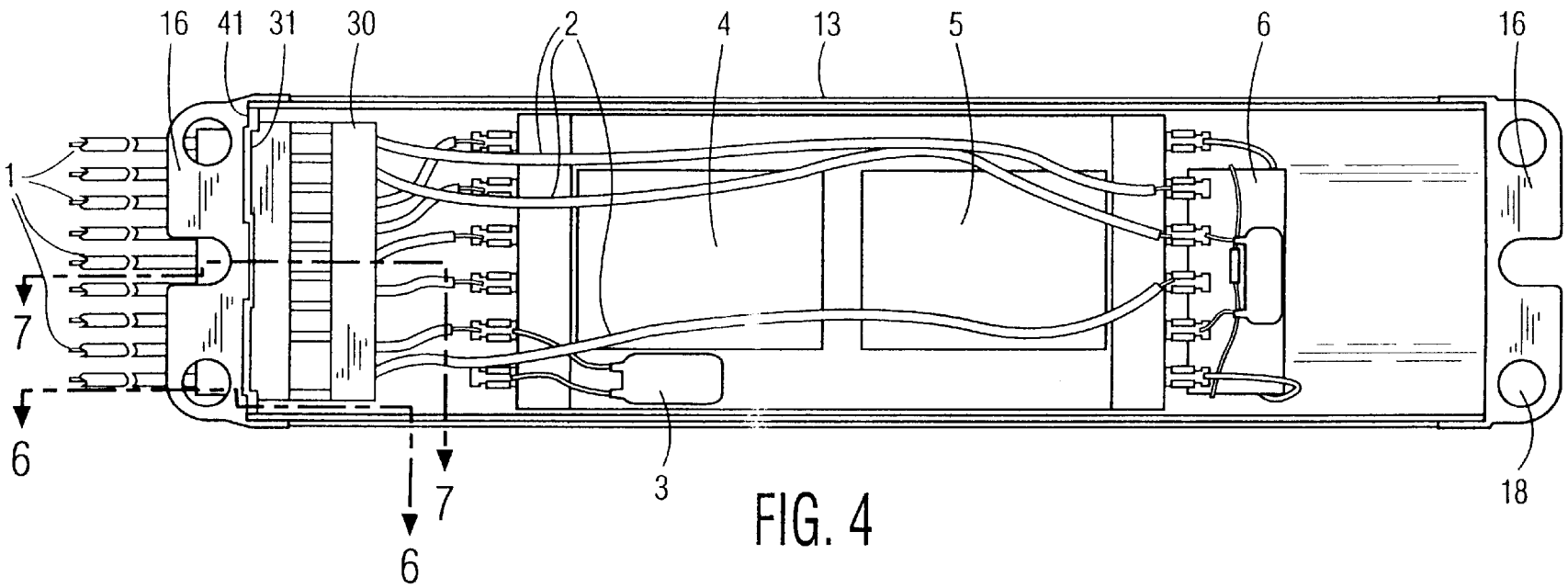
FIG. 4 is a plan view of a finished ballast can with the cover removed and showing the components within the can.
Figure 5A:
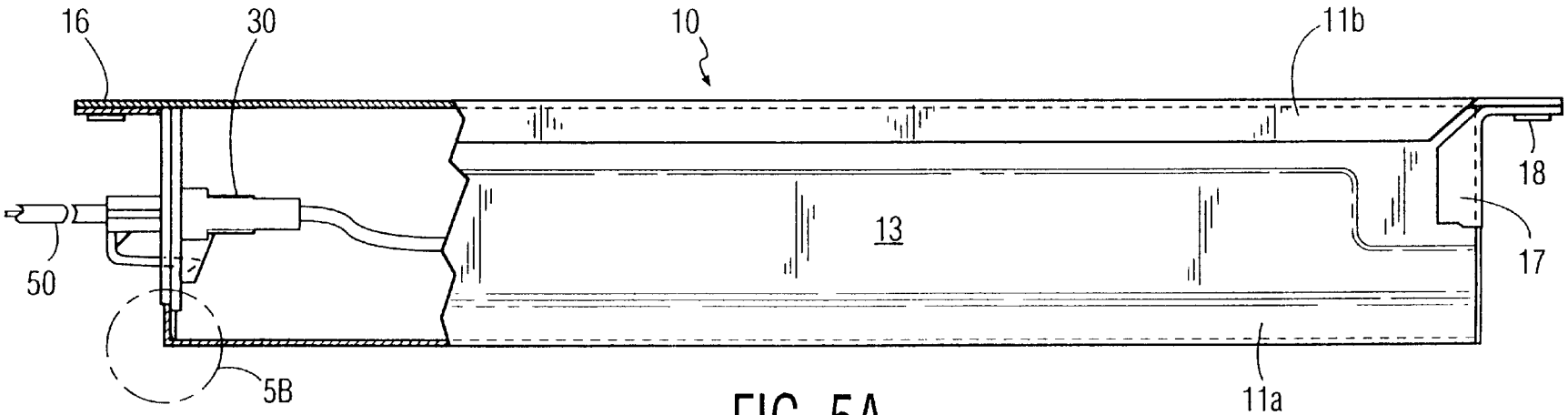
FIG. 5A is a partially cross-sectioned side elevation showing the cover plate in place on the finished ballast can of the FIG. 1 embodiment of the invention.
Figure 5B:
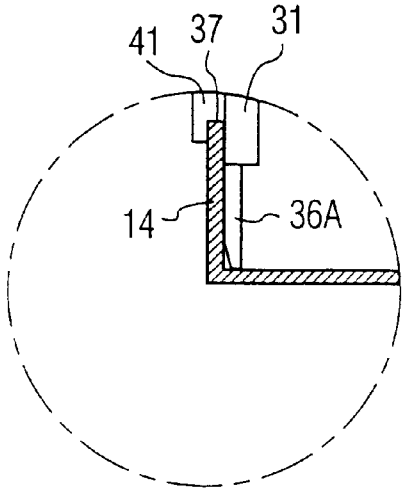
FIG. 5B is an enlarged view of a section 5B shown in FIG. 5A.

After the internal half-connector has been installed into the orifice and the ballast can is fully assembled, potting material (not shown) is poured into the cavity 15 and around the wires and associated parts and components as illustrated in FIG. 4 without leakage. The cover plate lib is then affixed as in FIG. 5 and the ballast allowed to cool and cure for solidification of the potting material.

Figure 6:
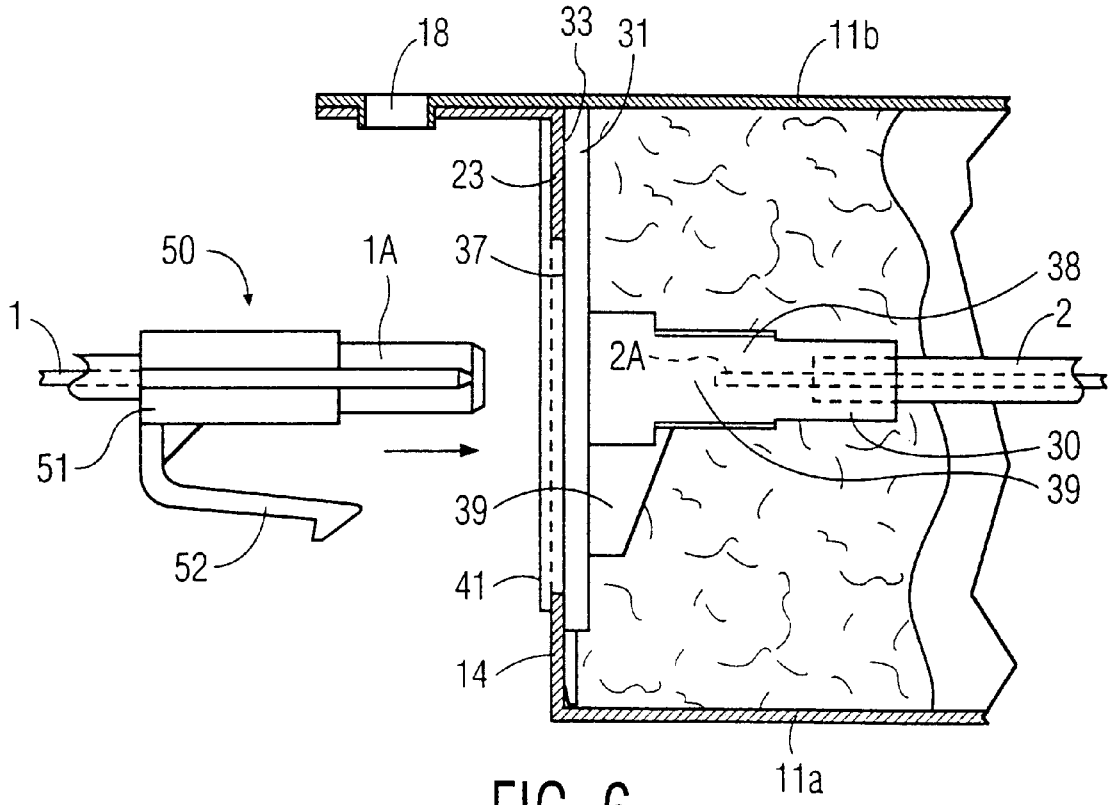
FIG. 6 is an elevation in partial cross-section along line 6—6 of FIG. 4, showing the internal and external half-connectors before they are mated, in a preferred embodiment of the invention.
Figure 7B:
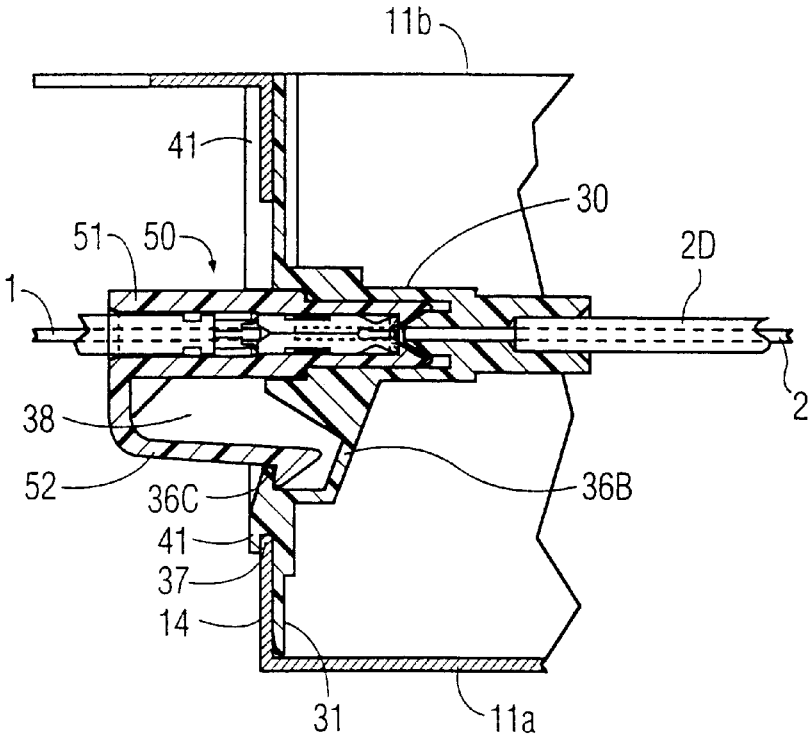
Figure 8:
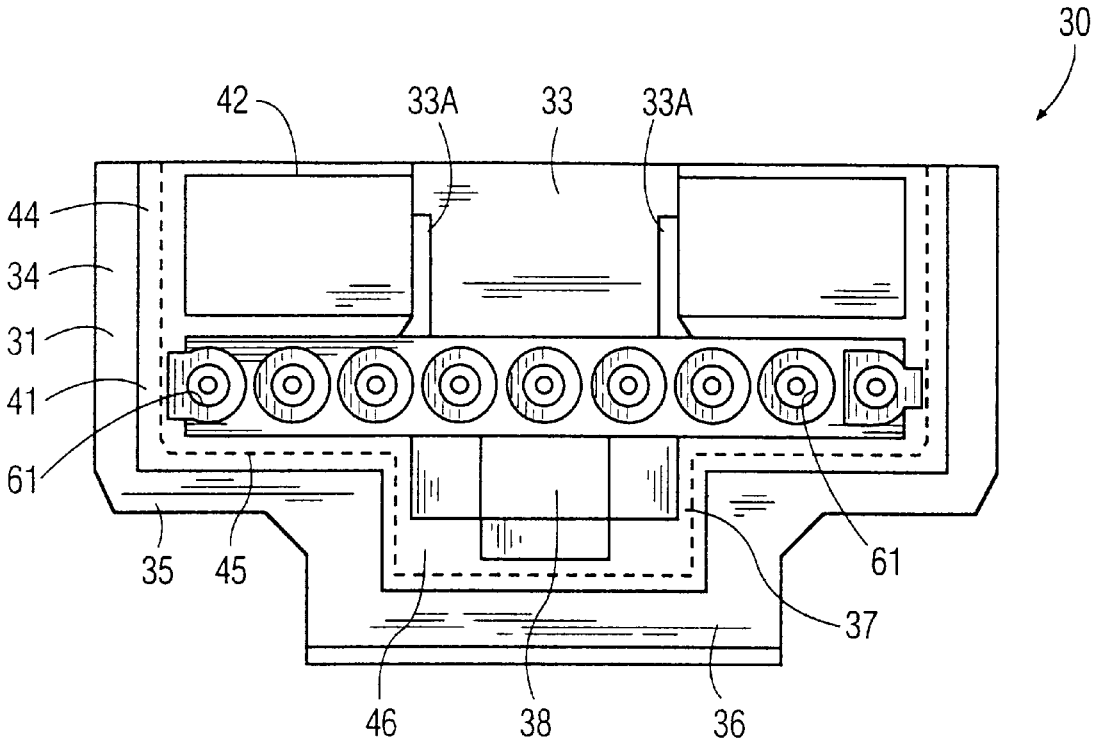
FIG. 8 is an outside end elevation of the receptacle or internal half-connector, which forms a mating connection with the external connector or plug, of the FIG. 6 embodiment of the invention.
Figure 13:
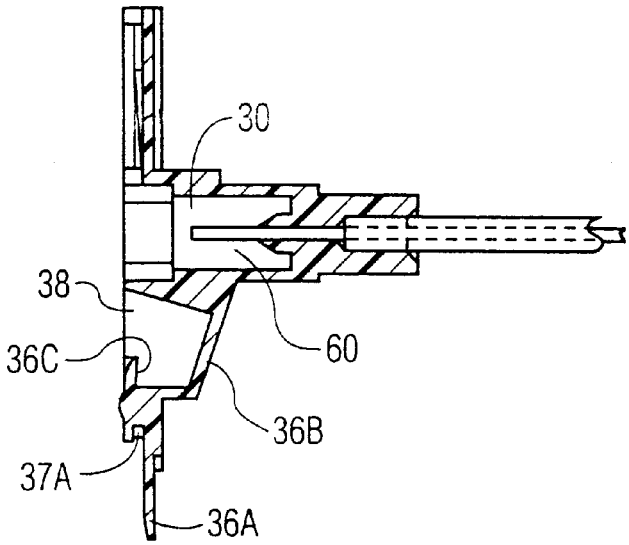
FIG. 13 is a cross-sectional view taken along line 13—13 of FIG. 12.

FIGS. 6 and 7B show the mating of the internal half-connector 30, external half-connector 50, and the end wall 14 for alternative embodiments of the invention. Additionally, FIGS. 8 12, and 13 show alternative embodiments of the invention. In the FIG. 12 and 13 embodiments, the inner end portion 31 of the half-connector 30 has outer tabs 36A depending from the bottom wall 36. According to the invention, these tabs aid in guiding the receptacle into the orifice. The extended surfaces or tabs 36A prevent the pressurized potting material from deforming the metal surface 14 , for example it prevents it from bulging.

As shown in these figures, the user can simply push the external half-connector 50 into place in the internal half-connector. During this process, the angled hook 52 passes into the cavity 38 and is retained therein until a user operates the hook by pressing its shank upwardly for removal. As shown in FIGS. 8, 10, 11 and 12, an internal half-connector 30 is segmented into nine contact-mating chambers 61. These chambers are cylindrical and are recessed within the body 39.

Figure 9:
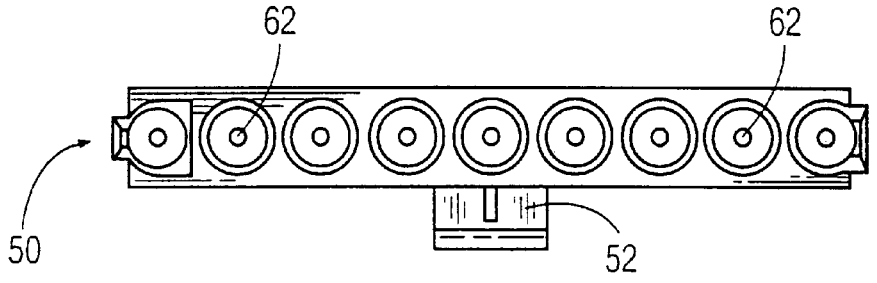
FIG. 9 is an outside end elevation view of the plug or external half-connector, which forms a mating connection with the internal connector or receptacle, of the FIG. 6 embodiment of the invention.

As shown in FIG. 9, an external half-connector 50 is similarly configured and segmented to form nine contact chambers 62 for retaining the preferably crimped socket to wire assembly.

Figure 10:
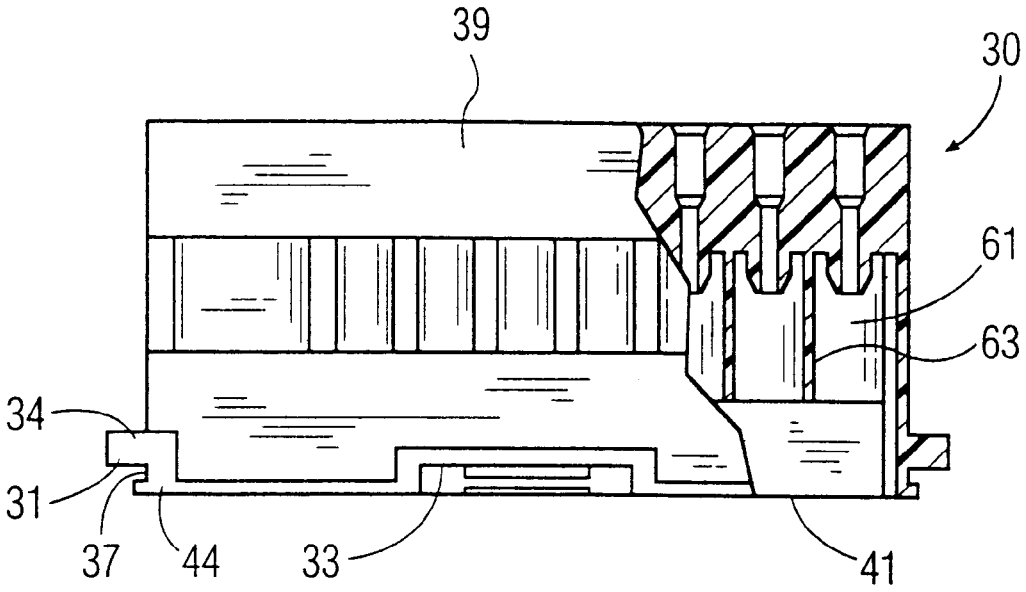
FIG. 10 is a partially cross-sectioned top plan view of the same receptacle.
Figure 11:
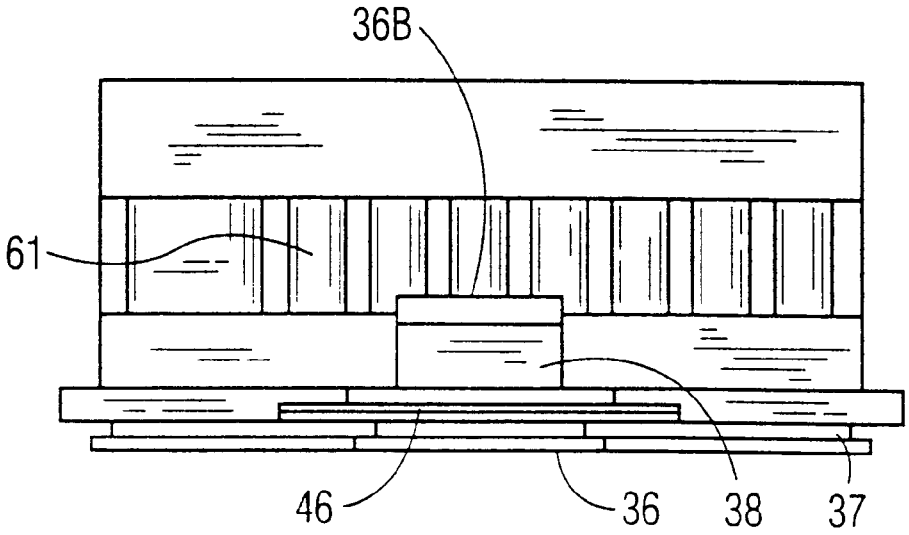
FIG. 11 is a bottom plan view of the same receptacle.

As illustrated in FIG. 10, the body 39 of the half-connector 30 comprises chambers 61 which are spaced apart from one another by walls 63 between the cylindrical interior surfaces of the chambers 61.

When the plug 50 and receptacle 30 are connected together, these contact chambers 62 of the plug are received and retained in the contact chambers 61 of the receptacle.

The electrical connecting devices of the invention is very readily adapted to ballast cans of a great variety of different shapes and dimensions. This is particularly accomplished through the use of the embodiment of FIGS. 12 and 13 wherein the tabs 36A may be made further outboard.

The invention may be embodied in other specific forms without departing from the spirit and scope or essential characteristics thereof, the present disclosed examples being only preferred embodiments thereof.

We claim:

1. An electrical connecting device which includes a housing comprising at least one orifice having disposed therein a connector for making electrical connection between electrical power-providing components and electrical power-receiving components, said connector comprising inner and outer flange means which substantially envelop edge portions of the orifice to provide a substantially continuous seal between at least side and bottom edge portions of said orifice and said connector;

said connector also comprising an opening for mating with a part of a second connector which opening includes a molded-in latch surface and a molded-in seal surface, said opening together with said part of said second connector forming a continuous seal.

2. An electrical connecting device as claimed in claim 1, wherein said edges portions of the orifice are contained in a groove formed between said inner and outer flange means, said flange means including collapsible projections at predetermined locations along the peripheral groove of the half-connector.

3. An electrical connecting device as claimed in claim 2, wherein said inner and outer flange means form a substantially continuous seal about the periphery of the side and bottom edge portions of said orifice.

4. An electrical connecting device as claimed in claim 1, wherein at least one edge portion of the orifice includes a tongue and said connector includes a wall portion having a groove complementary with said tongue formed therein.

5. An electrical connecting device as claimed in claim 4, wherein said tongue is formed in a top edge of the orifice and is mated with a complementary groove formed in a top wall portion of said connector.

6. An electrical connecting device, which comprises:

a housing having at least one orifice formed in a wall thereof, said orifice being defined by at least top edge, side edge, and bottom edge portions;

a first internal half-connector having a plurality of longitudinally extending chambers, each chamber including an electrical contact longitudinally disposed therein, said internal half-connector also including inner and outer flange means which form a substantially continuous seal about at least the side and bottom edge portions of said orifice, the connector and wall portion of the housing having complementary parts whereby upon assembly of the connector into the orifice, there is provided a substantially continuous seal between at least inner and outer side and bottom edge portions of said orifice and inner and outer side and bottom portions of said connector, said seal comprising inner and outer flange means provided on the connector which envelop said outer and inner side and bottom edge portions of the orifice;

a second external half-connector for detachable connection to said first internal half-connector, said second half-connector having a plurality of longitudinally extending chambers, the chambers of the first internal half-connector receiving the chambers of the second external half-connector to establish electrical contact of electrical components connected thereto, said second half-connector;

said first half-connector also comprising an opening for mating with a part of said second connector which opening includes a molded-in latch surface and a molded-in seal surface, said opening together with said part of said second connector forming a continuous seal.

7. An electrical connecting device as claimed in claim 6, wherein said second half-connector is a plug which includes a plug body having a flared end portion which assists in the proper insertion of the plug into the first half-connector, a hook for locking the second half-connector in engagement with the first half-connector, and release means for releasing the hook means to disengage the half-connectors; and a wire comprising a terminal inserted into the plug body.

8. An electrical connecting device as claimed in claim 7, wherein said second half-connector includes at least one wire and socket receiving passageway, and wherein each wire has at least one prong and a flared end portion that is complementary to the flared end portion of the plug body.

9. An electrical connecting device as claimed in claim 6, wherein at least one edge portion of the orifice includes a tongue and said internal half-connector includes a wall portion having a groove complementary with said tongue formed therein.

10. An electrical connecting device as claimed in claim 9, wherein said tongue is formed in a top edge portion of the orifice and is mated with a complementary groove formed in a top wall portion of said internal half-connector.

11. An electrical connecting device as claimed in claim 10, wherein said complementary groove comprises ramps which facilitate mating with the tongue.

12. An electrical ballast comprising a housing having at least one wall and comprising an electrical half-connector disposed in at least one orifice of said at least one wall, the half-connector and wall portion of the ballast housing having complementary parts whereby upon assembly of the half-connector into the orifice, there is provided a substantially continuous seal between at least inner and outer side and bottom edge portions of said orifice and inner and outer side and bottom portions of said connector, said seal comprising inner and outer flange means provided on the connector which envelop said outer and inner side and bottom edge portions of the orifice, said half-connector also comprising an opening for mating with a part of a second half-connector which opening includes a molded-in latch surface and a molded-in seal surface, said opening together with said part of a second connector forming a continuous seal.

13. An electrical ballast as claimed in claim 12, wherein said second half-connector comprises a flared end portion for assuring insertion of said second half-connector into said first half-connector.

* * * * *